US006641896B2

(12) United States Patent
Fensel et al.

(10) Patent No.: US 6,641,896 B2
(45) Date of Patent: Nov. 4, 2003

(54) WATER RESISTANT FIRE RETARDANT ROOF UNDERLAYMENT SHEET MATERIAL

(75) Inventors: Fred Fensel, Shaker Heights, OH (US); Rob Justus, Cleveland, OH (US)

(73) Assignee: The Garland Company, Inc., Cleveland, OH (US)

( * ) Notice: Subject to any disclaimer, the term of this patent is extended or adjusted under 35 U.S.C. 154(b) by 0 days.

(21) Appl. No.: 09/746,865

(22) Filed: Dec. 21, 2000

(65) Prior Publication Data

US 2002/0081924 A1 Jun. 27, 2002

(51) Int. Cl.[7] ..... B32B 27/04; B32B 27/12; B32B 11/02; B32B 11/10; B32B 11/12

(52) U.S. Cl. ..... 428/141; 428/143; 428/292.1; 428/294.7; 428/295.1; 428/297.4; 428/489; 428/920; 428/921; 442/74; 442/85; 442/86; 442/104; 442/131; 442/172; 442/180; 442/399; 442/414; 442/417

(58) Field of Search ..... 442/74, 85, 86, 442/172, 180, 399, 414, 417, 104, 131; 428/141, 142, 143, 144, 147, 206, 195, 292.1, 294.7, 295.1, 297.4, 489, 920, 921; 52/403.1, 408

(56) References Cited

U.S. PATENT DOCUMENTS

| | | | | | |
|---|---|---|---|---|---|
| 4,420,524 | A | * | 12/1983 | Gorgati | 428/110 |
| 4,595,636 | A | * | 6/1986 | Wiercinski et al. | 428/489 |
| 4,948,655 | A | * | 8/1990 | Danese | 428/213 |
| 5,326,797 | A | * | 7/1994 | Zimmerman et al. | 524/59 |
| 5,437,923 | A | * | 8/1995 | Kalkanoglu | 428/291 |
| 5,661,213 | A | * | 8/1997 | Arkens et al. | 524/555 |
| 5,723,546 | A | * | 3/1998 | Sustic | 525/240 |
| 6,341,462 | B2 | * | 1/2002 | Kiik et al. | 52/518 |

* cited by examiner

*Primary Examiner*—Ula Ruddock
(74) *Attorney, Agent, or Firm*—Hahn Loeser + Parks LLP; Stephen L. Grant

(57) ABSTRACT

A sheet material is useful as a waterproof underlayment for a roof of a structure. The sheet material has upper and lower surfaces and comprises a web of reinforcing mat comprising fire-resistant fibers and a continuous non-porous matrix of water-resistant modified bitumen saturating the web of reinforcing mat, wherein the modified bitumen is self-adhesive.

13 Claims, 1 Drawing Sheet

WATER RESISTANT FIRE RETARDANT ROOF UNDERLAYMENT SHEET MATERIAL

The present invention relates to a roof underlayment sheet material which is interposed between a combustible roof deck or substrate of a structure and a bottom surface of a roofing membrane such as a single ply, modified bitumen, built-up roof, or a metal standing-seam roof. Optional insulation may also be between this underlayment sheet material and bottom surface of roofing membrane. The underlayment sheet material provides both resistance to water and retardant effect to the spread of fire. Additionally, it may provide a temporary waterproofing roof membrane without any other membrane material.

BACKGROUND

In the construction industry, it is customary to provide a structure with an outer layer of protection against fire and weather. Typically, the outermost layer of the structure will be inherently fire and weather resistant. Most commonly these layers include brick or siding used on walls and metal, and metal, rubber, or bitumen based roofing systems used on roof decks. However, it is just as typical for the structural layer immediately below this outermost layer to comprise wood or another combustible material. It has become customary to interpose an underlayment between these two layers to enhance the protection of the structure, typically against moisture, vapor drive, water, and in some cases particularly, against fire. In addition to the resistance to these elements, it is also important that the underlayment sheet material be dimensionally stable under a variety of moisture and temperature conditions to be acceptable.

It is clearly desirable to achieve a "Class A" fire rating in a roofing membrane structure, as defined by Underwriters Laboratories Inc., with such an underlayment sheet material, as this permits construction without use of a barrier board layer, such as a gypsum barrier board. These barrier boards typically come in 4' by 4' or 4' by 8' board stock. Applying such a barrier board layer requires much more time than applying a rolled sheet material. It is also clearly desirable to be able to provide a temporary roof membrane to a structure so that water resistance is immediately provided even before the final roofing surface is applied.

Certain materials are known and useful as underlayment sheet materials for side walls and roofs. These include TYVEK, a spun-bonded polyolefin sheet material commercially available from E.I. duPont & Co. and tar paper, which is available from a variety of vendors. These underlayment sheet materials provide significant resistance against moisture, water, and vapor drive, but they offer little to no resistance to fire, and, in fact, present a fire hazard once ignited. There are also underlayment sheets which provide fire resistance but have no resistance to moisture, water, or vapor drive. These include the sheet material sold commercially as MANNIGLAS by the Manning Division of Lydall, Inc., Troy, N.Y. While the vendors of this type of material claim that it diverts water flow, there is no claim made as to preventing water intrusion.

As a result, it is a still unmet desire of the prior art to provide a self-adhering, moisture resistant, water resistant, and vapor drive resistant, fire retardant underlayment sheet material for a roofing deck.

SUMMARY OF THE INVENTION

It is therefore an advantage of the present invention to create an underlayment sheet material suitable for roofing and other applications that has the typical properties of being moisture resistant, water resistant, and vapor drive resistant with fire resistance. It is particularly desirable to combine these features with a pressure-sensitive adhesive coating on a lower face of the sheet. This invention is a membrane sheet material that consists of an inner core or reinforcement coated with bitumen creating a waterproof membrane. It is also desirable to provide an upper face of the sheet with a weathering surface. The membrane sheet material comes in a roll form which is unrolled for application and comes in typical lengths of 25 to 40 feet in length.

In a particular embodiment, the sheet material useful as a waterproof underlayment for a roof of a structure and having an upper and a lower surface comprises a web of reinforcing mat comprising fire-resistant fibers and a continuous non-porous matrix of water-resistant modified bitumen saturating the web of reinforcing mat; wherein the modified bitumen is self-adhesive. In such an embodiment, the reinforcing mat, having a density in the range of about 4 lbs/100 $ft^2$ comprises glass fibers. Further, the reinforcing mat is a non-woven mat of the glass fibers, held together by a dry binder adhesive. In many embodiments, the modified bitumen is an asphalt modified by a rubbery block co-polymer selected from the group consisting of: styrene-butadiene-styrene ("SBS"), styrene-isoprene-styrene ("SIS") and a combination of SBS and SIS. In such embodiments, the modified bitumen has a ring & ball softening point of at least about 215 F when measured under ASTM Method D36. The modified bitumen also has a penetration of about 45 dmm when measured under ASTM Method D5 and a low temperature flexibility of 50 mil film at 0°, as well as a viscosity of about 6800 cPs when measured at 350° F. under ASTM Method D4022. In the embodiments, the modified bitumen further comprises a tackifier, a plasticizing/process oil, an anti-oxidant and a ultraviolet stabilizer. Such a modified bitumen comprises about 80% by weight asphalt and rubbery block co-polymer, about 14.5% hydrocarbon resin, and about 5% naphthenic oil, with the anti-oxidant and ultraviolet stabilizers comprising the balance at less than 0.5%.

The sheet material will generally have its upper surface coated with a granular material, especially a coal slag aggregate.

The sheet material's lower surface has sufficient peel strength to adhere the sheet material in a waterproof manner.

The sheet material exhibits a Class A fire rating when measured ASTM Method E108 over a combustible deck.

BRIEF DESCRIPTION OF THE DRAWINGS

The inventive aspects of the present invention will be better understood when reference is made to the accompanying drawings, wherein identical parts are identified by identical reference numerals and wherein.

DETAILED DESCRIPTION OF THE INVENTION

Figure 1:
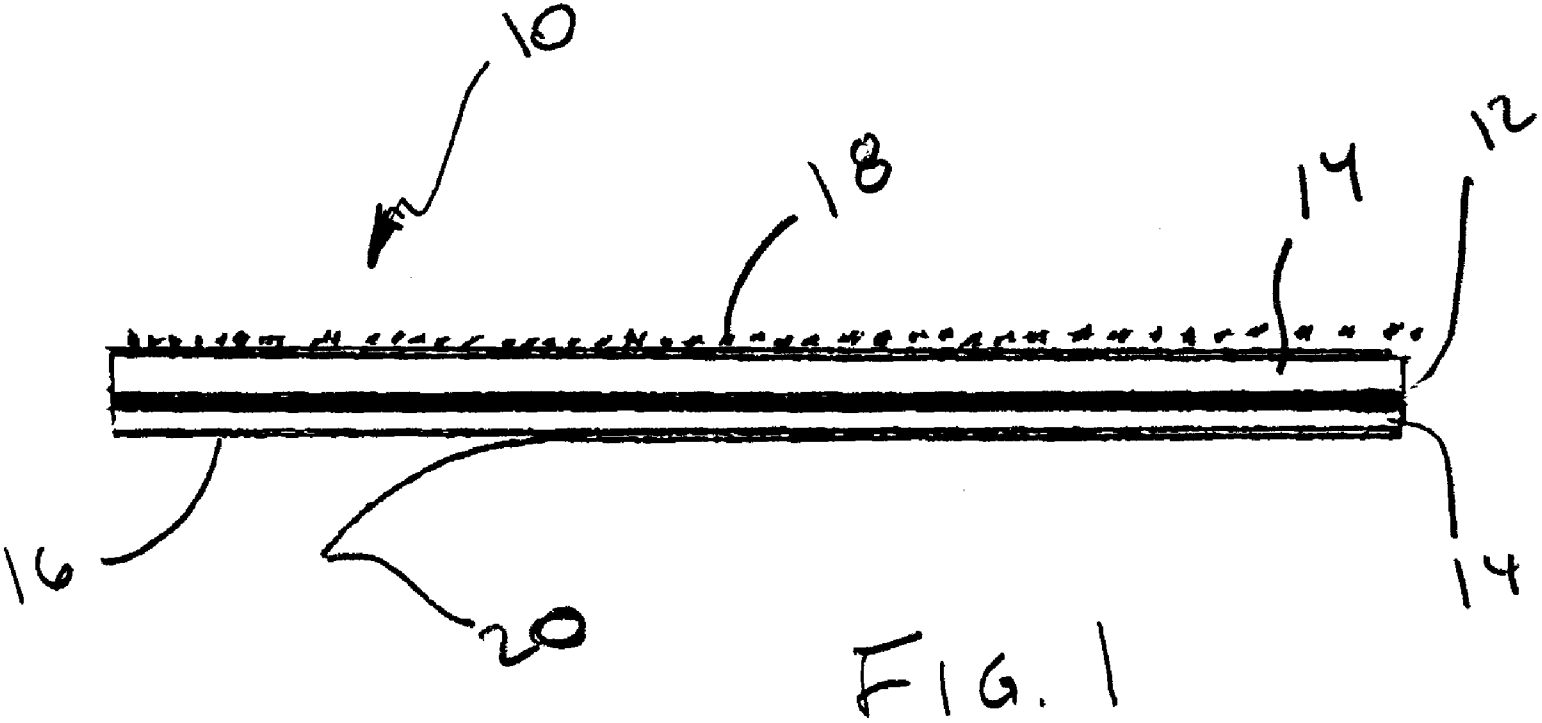
FIG. 1 shows a side sectional view of the sheet material of the present invention.

The sheet material 10 provided as a roof underlayment in the present invention comprises a fire-retardant reinforcing mat 12 that establishes a matrix into which a waterproofing material 14 has been saturated. In some aspects of the invention, a lower face of the resulting sheet is coated with a self-adhesive layer 16, and in yet further aspects, an upper face of the sheet is embedded with an additive 18 to provide weathering and traffic bearing characteristics. To protect the adhesive nature of the lower face and to permit rolling of the sheet for sale, it will be typical to place a release liner film 20 on the lower face until the sheet is installed.

In one aspect of the invention, the reinforcing mat 12 will be a mat comprising glass fibers meeting a weight specification of 4.0 lbs/100 $ft^2$. Such a glass mat, which is readily available from a number of commercial sources, will be likely to be of a wet laid process type comprising staple glass fibers held together by a dry binder adhesive. In the wet laid process, the mat is formed by distributing a slurry of staple glass fibers mixed with a mixed with liquid adhesive/binder onto a flat surface. As the slurry liquid evaporates, the resultant mat is a non-woven bed or mat of randomly oriented glass staple fibers, held loosely together by the binder adhesive. The mat possesses significant porosity to allow impregnation or saturation by a water-proofing substance, as will be described below. The mat is readily treated with additional binder or filler slurry to increase the fire resistant properties.

The agent or material 14 used to impregnate the reinforcing mat in most aspects of the present invention will be a self adhesive modified bitumen. The self adhesive modified bitumen will be a petroleum-derived material which has been modified by a rubbery block co-polymer, such as a styrene-butadiene-styrene ("SBS") or a styrene-isoprene-styrene ("SIS") polymer, or a combination of SBS and SIS components. Other additives may be used to increase tackiness and adhesive capability of the self adhesive modified bitumen, as well as adding oils, resins, tackifiers, and anti-oxidants.

One formulation for the self-adhesive modified bitumen would comprise about 62 wt. % asphalt, grade PG64-22, as supplied by Ashland-Marathon or Trumbull; about 14.75 wt % hydrocarbon resin, such as the Goodyear product WINGTACK PLUS or the Exxon product ESCOREZ 2101; about 12.5 wt. % SBS, supplied by Shell Elastomers under the trademark KRATON D1101 or by Dexco, under the trademark VECTOR 2411; about 5.5 wt. % of a naphthenic oil, such as the SHELLFLEX product manufactured by Equilon; about 5 wt. % SIS, selected from Dexco VECTOR 6214D, Enichem EUROPRENE T190, and Shell Elastomer KRATON D1107; about 0.25 wt % antioxidant, such as Ciba Additives IRGANOX 1010 brand; about 0.1 wt % ultraviolet stabilizers, such as either TINUVIN P or TINUVIN 770 DF, both from Ciba Additives.

The self-adhesive modified bitumen of the present invention will typically display a ring & ball softening point, as measured under ASTM Method D36 of 215 degrees F; a penetration of 45 dmm, as measured by ASTM Method D5; a low temperature flexibility of 50 mil film at 0 degrees F; and a viscosity of about 6800 cPs at 350 degrees F, when measured according to ASTM Method D4022.

A web of the fire retardant reinforcing mat useful for the present invention will be supplied rolled on a core, the web length usually ranging from 1,500 to 5,000 lineal yards per roll, and with a width usually of 40 inches. A roll of this mat is mounted on a conventional dip processing line as would be used to make base sheets, ply sheets, cap sheets, shingles, etc. As the web of mat is fed through the line, the web is submerged into and drawn through a tank of hot melt modified bitumen having a composition as described above, the passage through the modified bitumen resulting in impregnation and saturation of the mat, effectively rendering the previously porous mat impervious to moisture and generating a continuous matrix of the bitumen in which the reinforcing mat is embedded. As the mat passes through the hot melt bitumen, the sheet material formed from the continuous matrix of bitumen-saturated reinforcing mat emerges from the dipping apparatus having first and second generally planar faces defined by the width and length of the mat and a thickness, also effectively defined by the mat, the thickness being small relative to either the width or length. A typical thickness would be in the range of about 85 mils. Of the first and second planar faces, one will become the upper face and the other will become the lower face of the underlayment sheet being prepared. The upper face will receive a coating of a surfacing material such as the coal slag aggregate commonly known in the industry as "Black Beauty," to impart weathering and friction characteristics to the surface as well as to significantly decrease the effective tackiness inherent in the exposed uncovered bitumen sheet material. The lower surface will be covered with a peel away release film, such as a polyethylene release film, to allow the manufactured sheet material to be rolled upon itself for storage and transport, as well as to preserve the adhesive properties of the lower surface once the release film is removed. While the preceding description involves the use of a conventional dip process line, the present invention product can also be made on most other bitumen roll process lines such as calendering and extrusion processes. This coating process converts the fire retardant mat in a waterproofing roll good sheet material that can be used as a waterproofing roofing membrane alone as well as an underlayment.

In some embodiments, the underlayment may be formed by replacing the self adhesive modified bitumen coating by a conventional SBS modified bitumen coating to cover the web of fire retardant reinforcing mat. In this instance, a layer of self adhesive modified bitumen compound and release liner is applied to the bottom surface of the resulting membrane in a secondary operation.

The underlayment sheet material of the present invention will typically display a tensile strength at 77 F of about 75 $lb_f$/inch as measured by ASMT D146 in the both the machine direction and the cross machine direction. In this setting, "machine direction" refers to the direction in the plane of the web structure in which it is processed, while "cross machine direction" refers to the planar direction perpendicular to the machine direction. A roll of the sheet material would typically be supplied in rolls having about 34 lineal feet of the sheet material; such a roll would typically weigh about 56 pounds. The thickness, as noted above, would usually be about 85 mils. The peel strength of the lower face of the underlayment membrane is typically 3 to 6 pounds per lineal inch while the lap sheer strength over a 1-inch wide by 4 inch long area is in excess of the strength of the membrane with the test resulting in membrane failure.

This waterproofing fire retardant underlayment sheet material, when used in conjunction with a fire retardant coating, achieved a Class A fire rating per ASTM E-108, as tested by Underwriters Laboratories Inc. In such as case, the fire retardant coating is applied as a primer to a 13 to 14 inch width at the joints of a plywood decking material, particularly a combustible deck, 15/32 inch thick, at a ½ inch incline. The fire retardant coating used was "Garland Flame Screen," applied at 0.33 gal./$ft^2$ in a 14 in. width over the plywood joints overlapping the primer joint area. The ply sheet was one ply of 14 in. wide of the product of the present invention over the plywood joints, overlapping the strip joints, with a surfacing of one further ply of the product of the present invention.

The fire retardant coating used as a primer at the joints is similar to many such types of coatings. Two such commercially available primers are FLAME SCREEN from Structural Shield Systems, Inc. of Bradenton, Fla., and NO-BURN made by No-Burn Inc. of St. Clair, Mich. Other commercially available primers are expected to also be useful in achieving the same UL Class A rating.

While the foregoing specification has described the invention and particularly has described the best mode known to the inventors as of the filing date, the scope of the invention is not to be measured thereby, but is instead to be determined from the scope of the claims, which are appended hereto and made a part hereof.

What is claimed is:

1. A sheet material useful as a waterproof underlayment for a roof of a structure, the sheet material having an upper and a lower surface and comprising:

a web of reinforcing mat comprising fire-resistant fibers and filler; and a continuous non-porous matrix of water-resistant composition saturating the web of reinforcing mat;

wherein the water-resistant composition is self-adhesive and consists essentially of modified bitumen, tackifiers and processing oil.

2. The sheet material of claim 1 wherein the reinforcing mat, having a weight in the range of about 4 lbs per 100 square ft., comprises glass fibers.

3. The sheet material of claim 2 wherein the reinforcing mat, having a density in the range of about 4 lbs/100 $ft^2$, comprises glass fibers.

4. The sheet material of claim 1 wherein the modified bitumen comprises an asphalt modified by a rubbery block co-polymer selected from the group consisting of: styrene-butadiene-styrene ("SBS"), styrene-isoprene-styrene ("SIS") and a combination of SBS and SIS.

5. The sheet material of claim 4 wherein the modified bitumen has a ring & ball softening point of at least about 2150 F when measured under ASTM Method D36.

6. The sheet material of claim 4 wherein the modified bitumen has a penetration of about 45 dmm when measured under ASTM Method D5.

7. The sheet material of claim 4 wherein the modified bitumen has a low temperature flexibility of 50 mil film at 0° F.

8. The sheet material of claim 4 wherein the modified bitumen has a viscosity of about 6800 cPs when measured at 350° F. under ASTM Method D4022.

9. The sheet material of claim 4 wherein the water-resistant composition consists of:

about 80% by weight modified bitumen;

about 14.5% hydrocarbon resin as a tackifier; and about 5% naphthenic processing oil, with the anti-oxidant and ultraviolet stabilizers comprising the balance at less than 0.5%.

10. The sheet material of claim 1 wherein the upper surface of the sheet is coated with a granular material.

11. The sheet material of claim 10 wherein the granular material is a coal slag aggregate.

12. The sheet material of claim 1 wherein the lower surface has sufficient peel strength sufficient to provide a waterproof seal.

13. The sheet material of claim 1 wherein the sheet material exhibits a Class A fire rating when measured ASTM Method E-108 over a combustible deck.

* * * * *